US006609343B1

(12) United States Patent
Litten

(10) Patent No.: US 6,609,343 B1
(45) Date of Patent: Aug. 26, 2003

(54) OPEN-WEB-JOIST LOAD-SUPPORT SYSTEM

(76) Inventor: Timothy A. Litten, 5808 W. Arrowhead Lakes Dr., Glendale, AZ (US) 85308

( * ) Notice: Subject to any disclaimer, the term of this patent is extended or adjusted under 35 U.S.C. 154(b) by 0 days.

(21) Appl. No.: 09/721,221

(22) Filed: Nov. 22, 2000

(51) Int. Cl.[7] ..... A47B 96/06

(52) U.S. Cl. ..... 52/653.2; 52/655.1; 403/373; 403/344; 248/229.1; 248/229.14; 248/228.5

(58) Field of Search ..... 52/653.2, 655.1; 403/400, 373, 374.2, 374.3, 344; 248/229.1, 229.14, 229.24, 228.5, 62, 228.6

(56) References Cited

U.S. PATENT DOCUMENTS 2,846,169 A * 8/1958 Sullivan ..... 248/62
3,245,643 A * 4/1966 Morrow ..... 248/68
3,582,029 A * 6/1971 Moesta ..... 248/68
3,650,499 A * 3/1972 Biggane ..... 248/62
3,872,947 A * 3/1975 Cranfield ..... 182/82
4,516,296 A * 5/1985 Sherman ..... 24/279
6,098,942 A * 8/2000 Heath ..... 248/228.6
6,254,040 B1 * 7/2001 McGrath ..... 248/62

* cited by examiner

*Primary Examiner*—Carl D. Friedman
*Assistant Examiner*—Basil Katcheves
(74) *Attorney, Agent, or Firm*—Martin L. Stoneman

(57) ABSTRACT

Shown is a clamping system with multiple clamps that work in combination with each other to support a load attached to an open web joist. This clamping system is typically used to clamp a piping system, of the type commonly used to suspend a basketball backboard and basket, to an open web steel joist of a gymnasium. The clamp combines a prior art "horizontal" clamp subassembly, which clamps to the opposed "lips" of the open web joist, with a second clamp subassembly which provides a "vertical" clamp centered within the horizontal clamp, supported above the open top portion of the open web joist and extending through the open middle portion of the open web joist.

19 Claims, 3 Drawing Sheets

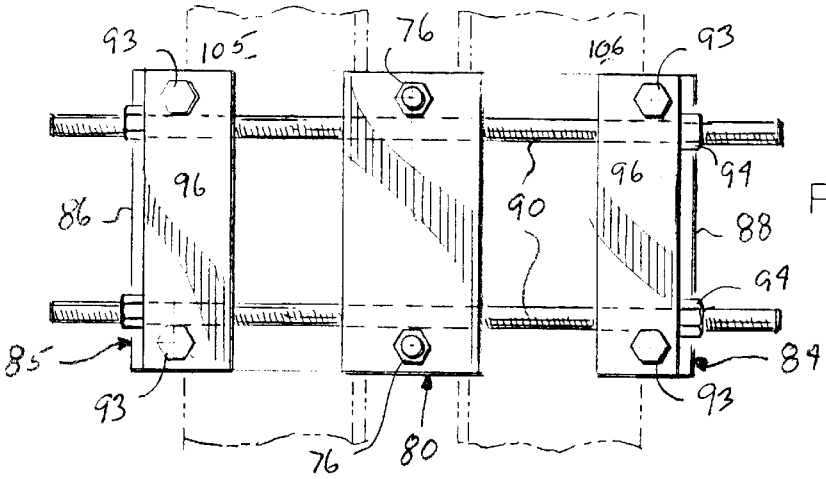
FIG. 6
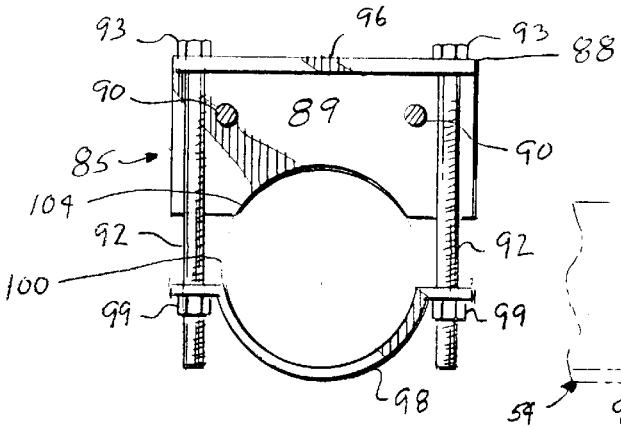
FIG. 8
FIG. 7
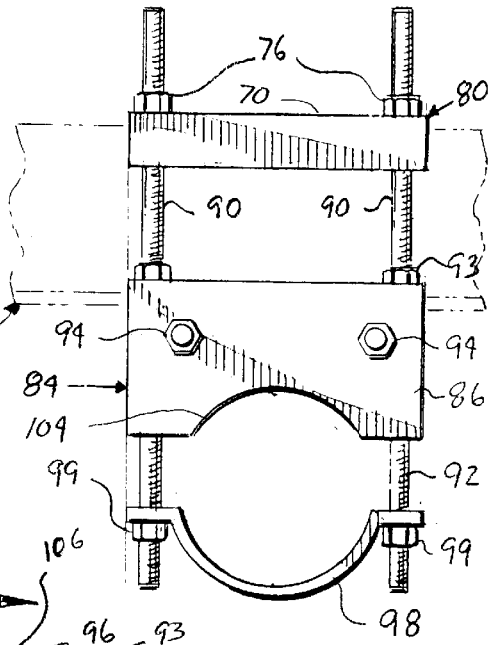
FIG. 5
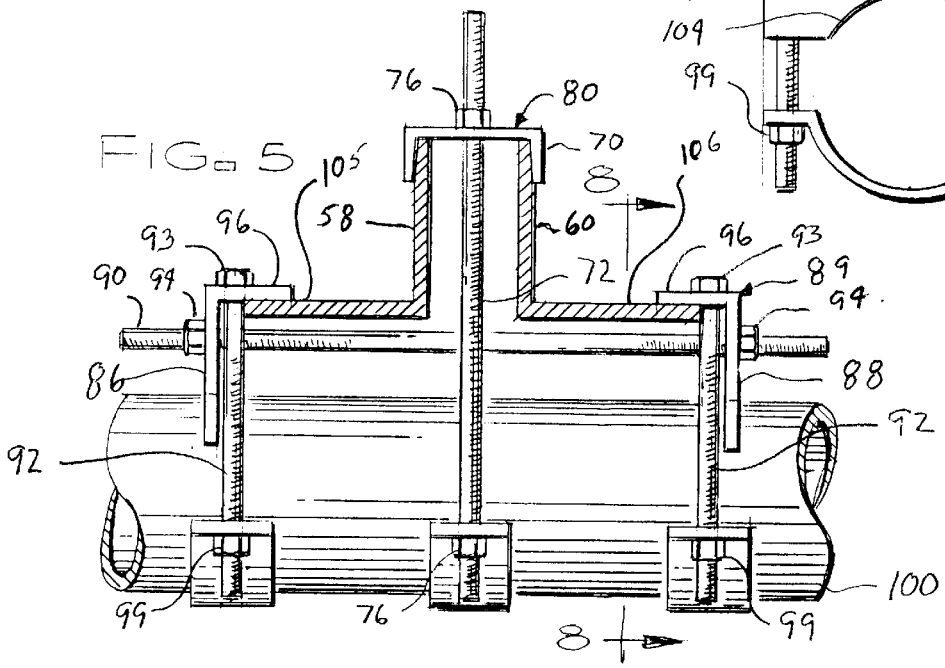

OPEN-WEB-JOIST LOAD-SUPPORT SYSTEM

BACKGROUND

This invention relates to providing a more efficient system for securing equipment to an open web steel joist of the type similar to that referenced in U.S. Pat. No. 4,748,786, incorporated herein by reference. More particularly, this invention concerns a clamping system that is preferably used to clamp a piping system, of the type commonly used to suspend a basketball backboard and basket, to an open web steel joist of the type commonly used to support a gymnasium building roof structure.

Typically, large buildings such as schools, wholesale and retail buildings, manufacturing buildings and sports complexes, including gymnasiums, are often fabricated using open web style steel joists. Such joists extend from the walls of a building or from girders which extend from the walls, and support either the roof of the building or a higher floor. In gymnasiums, installation of basketball equipment is common. The basketball equipment is usually supported from the open web style steel joists. One method (illustrated later herein in detail as "prior art") of securing the basketball equipment to the joists has been that of using a horizontal compressive clamp consisting of two L-shaped brackets attached to two vertical pipe clamp holders. The L-shaped brackets fit over the top of the upside down L-shaped ends of the open web joist. As the bracket is tightened, it compresses and holds onto the open web joist. The bottom end of the bracket attaches with a pipe clamping means to the pipe used to support the basketball equipment, thereby suspending the equipment from the roof structure.

The above-described clamp has several innate problems associated with it. For example, over-tightening of the horizontal clamp results in the clamp bending such that it does not firmly grip the L-shaped ends of the open web joist. This may result in slippage and the clamp (and the basketball equipment assembly) coming loose. As a further example, the weight of the basketball equipment is stressed on literally just the ends of the open web joist. And vibratory and other movements of the basketball equipment, as commonly occurs in these types of installations, can cause movement of the clamp along the joist and/or a failure in the holding of the clamp onto the open web joist.

OBJECTS OF THE INVENTION

A primary object and feature of the present invention is to fill the above-mentioned needs by the provision of an improved clamping system for attaching a load to an open web steel joist. In addition, it is a primary object and feature of this invention to provide such a system that supports a load with a clamp that provides direct vertical support by an open web joist and indirect vertical support utilizing a horizontal clamp. A further primary object and feature of the present invention is to provide such a device or system which is efficient, inexpensive, and handy. Other objects and features of this invention will become apparent with reference to the following invention descriptions.

SUMMARY OF THE INVENTION

According to a preferred embodiment of the present invention, this invention provides an open-web-joist clamping system for supporting a load from an open-web joist, having a longitudinal open middle portion and transversely opposed longitudinal bottom lips, comprising, in combination: a first clamp means for supporting the load while clamping the joist horizontally; and a second clamp means for supporting the load while clamping the joist vertically wherein such second clamp means is adjacent such first clamp means. It also provides such a system wherein such second clamp means is structured and arranged to clamp on the open-web joist adjacent the open middle portion. And it provides such a system wherein such first clamp means is structured and arranged to clamp onto the transversely opposed longitudinal bottom lips. Additionally, it provides such a system further comprising a third clamp means for attaching such first clamp means and such second clamp means to the load. Further, it provides such a system wherein such third clamp means comprises a pipe-holding means for supporting a load-holding pipe; and wherein such third clamping means is structured and arranged to support a basketball equipment assembly. Still further, it provides such a system wherein such third clamping means comprises a pipe-holding means for supporting a basketball equipment assembly. It also provides such a system wherein such second clamp means is substantially centered with respect to such first clamp means.

Further, according to a preferred embodiment of the present invention, this invention provides an open-web-joist clamping system for supporting a load from an open-web joist, having a longitudinal open middle portion and transversely opposed longitudinal bottom lips, comprising, in combination: at least one first clamp assembly structured and arranged to support the load while clamping the joist horizontally; and at least one second clamp assembly structured and arranged to support the load while clamping the joist vertically wherein such second clamp assembly is adjacent such first clamp assembly. It also provides such a system wherein such second clamp assembly is structured and arranged to clamp the open-web joist vertically adjacent the open middle portion. And it provides such a system wherein such first clamp assembly is structured and arranged to clamp such first clamp subassembly so as to tightly hold onto the transversely opposed longitudinal bottom lips of the open web joist. Also, it provides such a system further comprising a set of load holding-assemblies structured and arranged to attach such first clamp assembly and such second clamp assembly to the load. Moreover, it provides such a system wherein each such load holding assembly comprises a pipe-holding clamp structured and arranged to support a load-holding pipe; and further, wherein such set of load holding assemblies are structured and arranged to support a basketball equipment assembly. Still further, it provides such a system wherein such set of load holding assemblies comprise a pipe-holding clamp structured and arranged to support a basketball equipment assembly; and, further, wherein such first clamp assembly and such second clamp assembly each provide independent support to the load. Even further, it provides such a system wherein such second clamp assembly is substantially centered with respect to such first clamp assembly and wherein such second clamp assembly comprises: at least two vertical bars, each having a first end and a second end; a structural member comprising a flat portion, comprising at least two first apertures, each holding one such first end of one such vertical bar; a load-support member having at least two second apertures, each holding one such second end of one such vertical bar; and at least two bar-height adjusting members, each fitting one such end of one such vertical bar, wherein such structural member is structured and arranged so that such flat portion may be supported only over the longitudinal open middle portion of the open-web joist, and wherein such load-support member is structured and arranged to support the load, whereby adjusting such bar-height adjusting members causes such structural member and such load-support member to be drawn closer together, thereby supporting the load by the open-web joist.

In addition, according to a preferred embodiment of the present invention, this invention provides an open-web-joist clamping system for supporting a load from an open-web joist, having a longitudinal open middle portion and a pair of transversely opposed longitudinal bottom lips, comprising, in combination: a first clamp assembly comprising at least two horizontal bolts, each such horizontal bolt having a first threaded end and a second threaded end, two opposing clamp subassemblies wherein each such opposing clamp subassembly comprises at least two first vertical bolts, each such first vertical bolt having a first end and a second threaded end, an inverted L-shaped angle member having a planar top surface and a side surface, at least two first apertures, in such L-shaped angle member top surface, each such first aperture holding a such first end of one such vertical bolt, at least two second apertures, in such side surface, each such second aperture holding one end of one such horizontal bolt, an upwardly concave half-clamp member having at least two third apertures, each such third aperture holding a such second threaded end of one such first vertical bolt, at least two first threaded nuts, each such first threaded nut fitting one such second threaded end of one such first vertical bolt, at least two second threaded nuts, each such second threaded nut fitting such one end of such horizontal bolt, wherein a bottom portion of such side surface comprises a downwardly concave clamping surface, wherein a leading portion of such top surface of such inverted L-shaped angle member is structured and arranged to fit over one transversely opposed longitudinal bottom lip of the open web joist, wherein such upwardly concave half-clamp member is structured and arranged to support the load, and wherein such first vertical bolts connect such L-shaped angle member and such upwardly concave half-clamp member, whereby tightening such nuts fitting such first vertical bolts clamps together each such L-shaped angle member with each such upwardly concave half-clamp member, and tightening such nuts fitting such horizontal bolts is arranged to clamp such first clamp subassembly so as to tightly hold onto the transversely opposed longitudinal bottom lips of the open web joist; and a second clamp assembly comprising at least two second vertical bolts, each having a first threaded end and a second threaded end, an inverted U-shaped channel member having a flat top portion, comprising at least two fourth apertures, each holding one such first threaded end of such second vertical bolt, and two side portions, an arcuate half-clamp member having at least two fifth apertures, each holding one such second threaded end of such second vertical bolt, and a least four third threaded nuts, each fitting one such threaded end of one such second vertical bolt, wherein such inverted U-shaped channel member is structured and arranged so that such flat top portion may be supported only over the longitudinal open middle portion of the open-web joist, and wherein such arcuate half-clamp member is structured and arranged to support the load, whereby tightening such third threaded nuts causes such inverted U-shaped channel member and such arcuate half-clamp member to be drawn closer together thereby supporting the load by the open-web joist; wherein such second clamp assembly is substantially centered with respect to such first clamp assembly; whereby, when such first clamp assembly and such second clamp assembly are both supported by the open-web joist and are both supporting the load, such first clamp assembly and such second clamp assembly function together to provide improved load support.

Even further, according to a preferred embodiment of the present invention, this invention provides an open-web-joist load-support system for supporting a load from an open-web joist, having a longitudinal open middle portion and a pair of transversely opposed longitudinal bottom lips, comprising, in combination: a hanger, structured and arranged to be supported by the open-web joist only adjacent and above the longitudinal open middle portion, arranged to support a hung load; and a capture, structured and arranged to be supported by such hanger, arranged to capture the hung load. It also provides such a system wherein such hanger comprises: at least one vertical connection system having an upper end and a lower end and sufficient tensile strength to support the hung load; and a structural member comprising a flat portion, and at least one attachment between such structural member and such upper end; wherein such structural member is structured and arranged so that such flat portion will be supported only over the longitudinal open middle portion of the open-web joist. Still further, it provides such a system wherein such vertical connection system is structured and arranged so that an upper portion of such vertical connection system will be situated substantially within the longitudinal open middle portion of the open-web joist.

BRIEF DESCRIPTION OF THE DRAWINGS

FIG. 5 is a side view, partially in section, of the preferred embodiment of FIG. 3 (installed on the joist).

FIG. 6 is a top view of the illustrated embodiment of the present invention.

FIG. 7 is an end view of the illustrated preferred embodiment of the present invention.

FIG. 8 is a side view, partially in section, through the section 8—8 of FIG. 5.

DETAILED DESCRIPTION OF A PREFERRED EMBODIMENT AND BEST MODE OF PRACTICE

Figure 1:
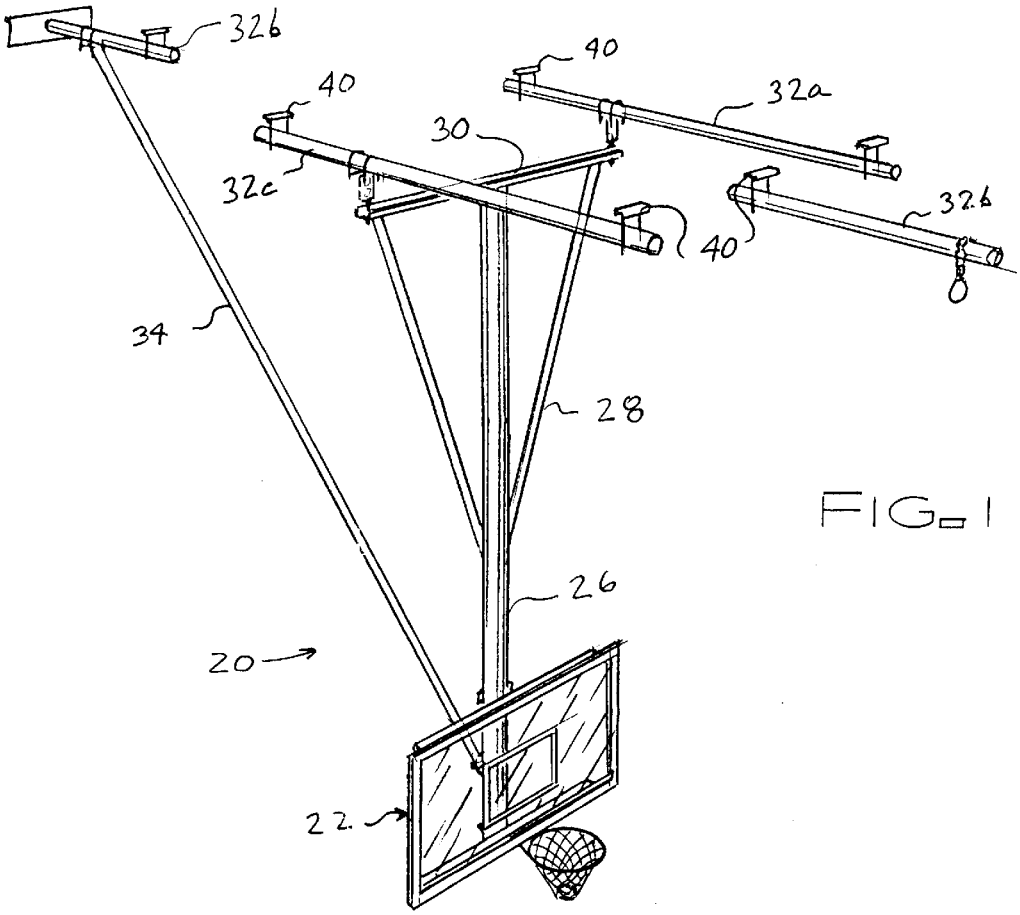
FIG. 1 is a perspective view, for explanatory purposes, of an embodiment of a basketball equipment assembly commonly installed in a gymnasium.

Illustrated in FIG. 1 is a perspective view of an embodiment of a basketball equipment-assembly 20 commonly installed in a gymnasium. One preferred embodiment of the present invention is an improved clamping system for attaching, and thereby hanging, the basketball equipment assembly 20 from a typical gymnasium roof structure. The basketball equipment assembly 20 has an overhead supported backstop 22 with a fully welded vertical frame assembly. In a typical embodiment of the basketball equipment assembly 20, the frame assembly consists of a main center mast 26 of 6-⅝" O.D. heavy wall structural steel tubing. Diagonal side sway braces 28 are fabricated from 1-½"×3" structural steel rectangular tubing. The top horizontal mast 30 consists of heavy 2"×4" structural steel channel. The main mast frame assembly 32 consists of three 3-½" O.D. tubing members 32*a*, 32*b* and 32*c*. A rear brace 34 is positioned with the overhead supported backstop 22 plumb and vertical to the floor (not shown). The rear brace 34 consist of 2" tubing. The main mast frame assembly 32 typically consists of 3-½" O.D. tubing and is preferably anchored to roof framing members (shown in FIG. 3 as an open web steel joist 50) using an embodiment of the present invention, herein referred to as a triple clamp system 40.

Figure 2:
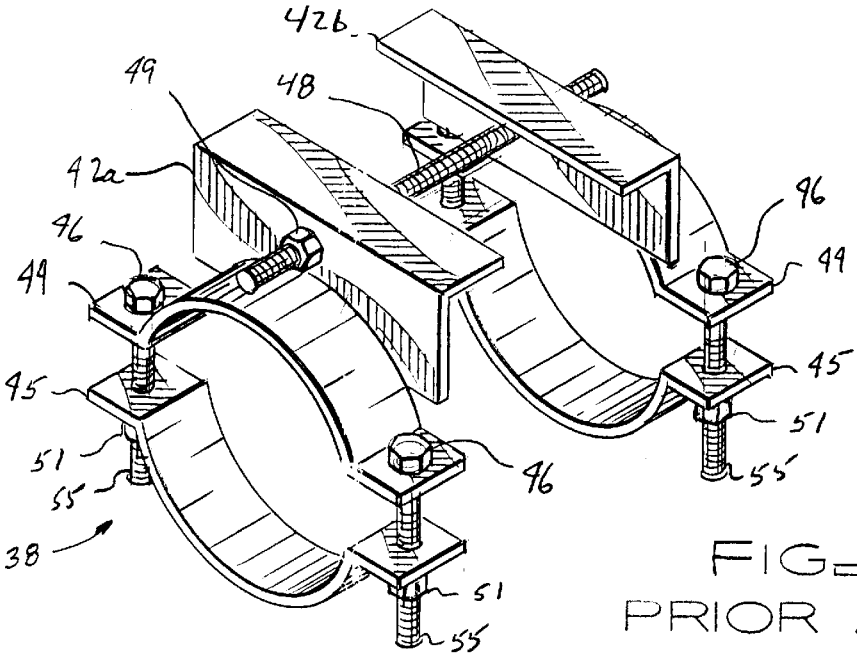
FIG. 2 PRIOR ART
FIG. 2 is perspective view illustrating the prior art of a clamp commonly used on an open web steel joist truss.
Figure 3:
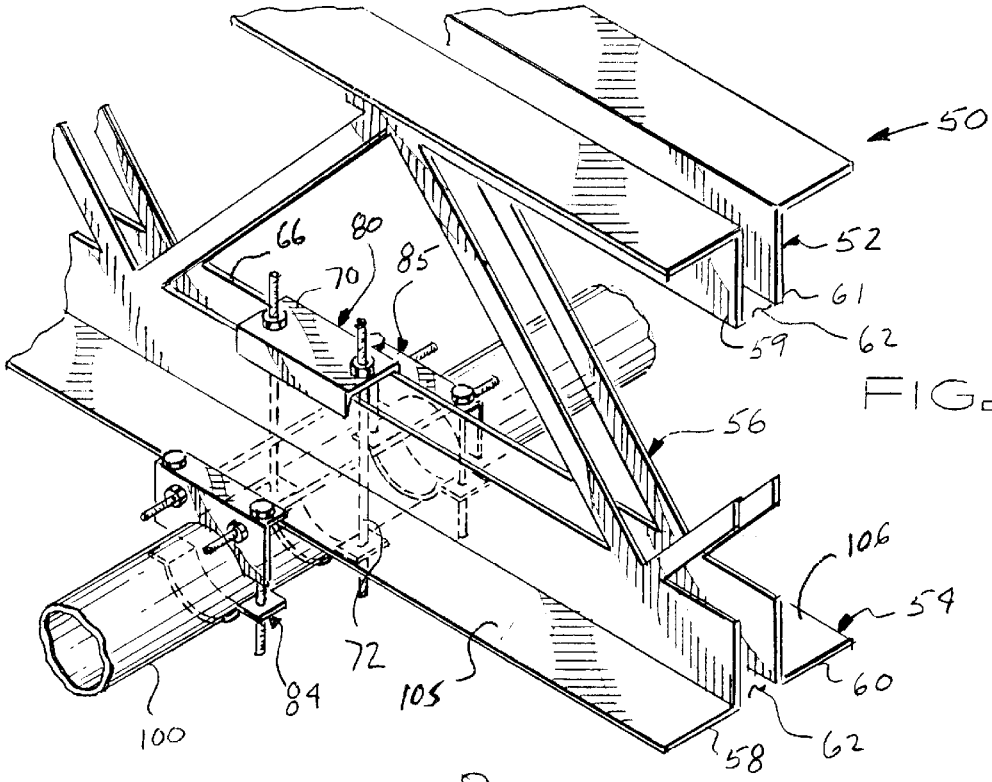
FIG. 3 is a perspective view of a preferred embodiment of the present invention installed on an open web steel joist.

FIG. 2 illustrates prior art, a horizontal joist clamp 38 which clamps onto the L-shaped steel angle sides 58 and 60 of the open web steel joist 50 (shown in FIG. 3). The clamp consists of two semi-circular C-clamps, an upper clamp portion 44 and a lower clamp portion 45, weldably attached to each L-angle 42*a* and 42*b*. Bolts 46 extend through an upper clamp portion 44 and a lower clamp portion 45. Bolts 46 have a hex head top and a nut 51 attached on a threaded end 55. The nut 51, when tightened in well-known ways by those skilled in the art, causes the lower clamp portion 45 to be raised and clamped toward the upper clamp portion 44. A single bolt 48 extends through the middle of the L angles 42*a* and 42*b*. The single bolt 48 is usually an all-thread style (i.e., the entire bolt has threads) of bolt and has nut 49 threadably attached at each end. When the nuts 49 are tightened, (again, in well known ways by those skilled in the art) the L angles 42*a* and 42*b* are moved toward one another. Typically, these L angles 42*a* and 42*b* are set over the transversely opposite L-shaped steel angle sides 58 and 60 of the open web steel joist 50 as shown in FIG. 3. Preferably, the prior art horizontal joist clamp 38 is tightened by tightening the nuts 49 and 51 such that the lower clamp portion 45 and upper clamp portion 44 are drawn together vertically and the L angles 42*a* and 42*b* are drawn together horizontally, causing the pipe 100 (shown in FIG. 3) to be clamped to the transversely opposed L-shaped steel angles 58 and 60 of the open web steel joist 50. These types of clamps, which only hold onto a small portion of the sides of the open web joist, may at times slip off the joist, as mentioned in the background comments.

Referring now to FIG. 3, illustrated in FIG. 3 is an open web steel joist 50 (embodying herein an open-web-joist, having a longitudinal open middle portion and transversely opposed longitudinal bottom lips) of the type similar to that referenced in U.S. Pat. No. 4,748,786, incorporated herein by reference. Large buildings such as schools, wholesale and retail buildings, manufacturing buildings and sports complexes, including gymnasiums, are often fabricated using open web style steel joists. Such joists extend from the walls of a building or from girders which extend from the walls, and support either the roof of the building or a higher floor. An open web steel joist 50 consists of a top chord 52, a bottom chord 54 and a web section 56 extending between them. The top chord 52 and bottom chord 54 are comprised of a pair of generally L-shaped steel angles, shown as transversely opposed L-shaped steel angles 58–61 which are arranged in a T-shape, back-to-back (embodying herein transversely opposed longitudinal bottom lips of the open web joist). The two T-shaped sections are joined bottom-T to bottom-T by web sections 56 formed in the shape of a V, as shown. The parts are welded together at the ends of the L and apexes of the V. The manner in which the open web steel joist 50 is manufactured creates a space 62 (embodying herein a longitudinal open middle portion) between the L-shaped steel angles 58, 59, 60 and 61.

Figure 4:
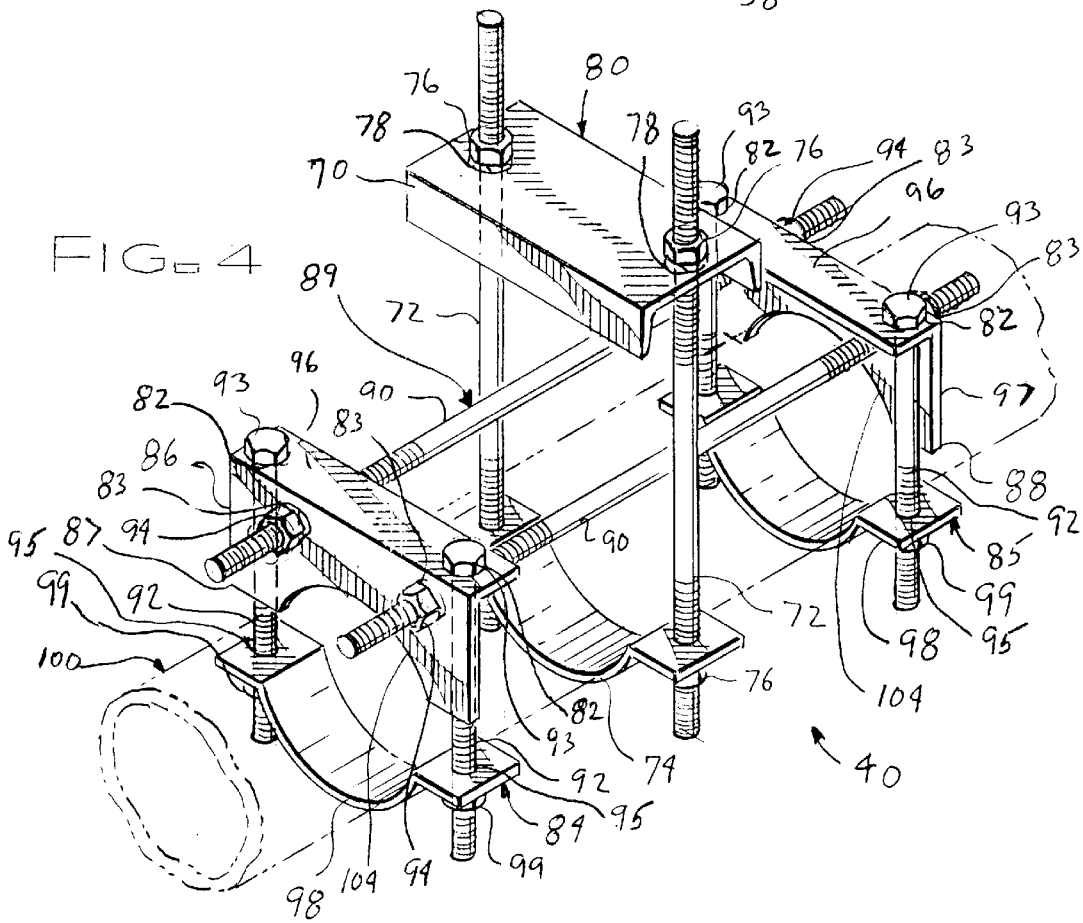
FIG. 4 is a perspective view of the preferred embodiment of FIG. 3, showing only the clamp subassemblies.

Illustrated in FIGS. 3 and 4 is an embodiment of the triple clamp system 40 (embodying herein an open-web-joist clamping system for supporting a load from an open-web joist, having a longitudinal open middle portion and transversely opposed longitudinal bottom lips), consisting of a first clamp: horizontal clamp 89, and a second clamp: vertical clamp 80. Horizontal clamp 89 embodies herein a first clamp means for supporting the load while clamping the joist horizontally; and at least one first clamp assembly structured and arranged to support the load while clamping the joist horizontally. Horizontal clamp 89 also embodies herein (as shown) a first clamp assembly comprising at least two horizontal bolts, each such horizontal bolt having a first threaded end and a second threaded end, two opposing clamp subassemblies wherein each such opposing clamp subassembly comprises at least two first vertical bolts, each such first vertical bolt having a first end and a second threaded end, an inverted L-shaped angle member having a planar top surface and a side surface, at least two first apertures, in such L-shaped angle member top surface, each such first aperture holding a such first end of one such vertical bolt, at least two second apertures, in such side surface, each such second aperture holding one end of one such horizontal bolt, an upwardly concave half-clamp member having at least two third apertures, each such third aperture holding a such second threaded end of one such first vertical bolt, at least two first threaded nuts, each such first threaded nut fitting one such second threaded end of one such first vertical bolt, at least two second threaded nuts, each such second threaded nut fitting such one end of such horizontal bolt, wherein a bottom portion of such side surface comprises a downwardly concave clamping surface, wherein a leading portion of such top surface of such inverted L-shaped angle member is structured and arranged to fit over one transversely opposed longitudinal bottom lip of the open web joist, a) wherein such upwardly concave half-clamp member is structured and arranged to support the load, and wherein such first vertical bolts connect such L-shaped angle member and such upwardly concave half-clamp member, whereby tightening such nuts fitting such first vertical bolts clamps together each such L-shaped angle member with each such upwardly concave half-clamp member, and b) tightening such nuts fitting such horizontal bolts is arranged to clamp such first clamp subassembly so as to tightly hold onto the transversely opposed longitudinal bottom lips of the open web joist.

Vertical clamp 80 embodies herein (as shown) a second clamp means for supporting the load while clamping the joist vertically; wherein such second clamp means is adjacent such first clamp means. It also embodies herein at least one second clamp assembly structured and arranged to support the load while clamping the joist vertically. And it further embodies herein such second clamp assembly which is structured and arranged to clamp the open-web joist vertically adjacent the open middle portion. And still further embodies herein such second clamp assembly which is substantially centered with respect to such first clamp assembly and wherein such second clamp assembly comprises: at least two vertical bars, each having a first end and a second end; a structural member comprising a flat portion, comprising at least two first apertures, each holding one such first end of one such vertical bar; a load-support member having at least two second apertures, each holding one such second end of one such vertical bar; and at least two bar-height adjusting members, each fitting one such end of one such vertical bar, wherein such structural member is structured and arranged so that such flat portion may be supported only over the longitudinal open middle portion of the open-web joist, and wherein such load-support member is structured and arranged to support the load, whereby adjusting such bar-height adjusting members causes such structural member and such load-support member to be drawn closer together, thereby supporting the load by the open-web joist.

FIG. 4 is a partial expanded perspective view illustrating more of the detail of the embodiment of FIG. 3; FIG. 6 is a top view of the illustration of FIG. 4; and FIG. 7 an end view thereof. With reference to these figures, in the illustrated preferred embodiment, horizontal clamp 89 consists of two vertical pipe clamp holder assemblies 84 and 85. Pipe clamp holder assemblies 84 and 85 embody herein (as shown) two opposing clamp subassemblies wherein each such opposing clamp subassembly comprises at least two first vertical bolts, each such first vertical bolt having a first end and a second threaded end, an inverted L-shaped angle member having a planar top surface and a side surface, at least two first apertures, in such L-shaped angle member top surface, each such first aperture holding a such first end of one such vertical bolt, at least two second apertures, in such side surface, each such second aperture holding one end of one such horizontal bolt, an upwardly concave half-clamp member having at least two third apertures, each such third aperture holding a such second threaded end of one such first vertical bolt, at least two first threaded nuts, each such first threaded nut fitting one such second threaded end of one such first vertical bolt, at least two second threaded nuts, each such second threaded nut fitting such one end of such horizontal bolt, wherein a bottom portion of such side surface comprises a downwardly concave clamping surface, wherein a leading portion of such top surface of such inverted L-shaped angle member is structured and arranged to fit over one transversely opposed longitudinal bottom lip of the open web joist, wherein such upwardly concave half-clamp member is structured and arranged to support the load, and wherein such first vertical bolts connect such L-shaped angle member and such upwardly concave half-clamp member, whereby tightening such nuts fitting such first vertical bolts clamps together each such L-shaped angle member with each such upwardly concave half-clamp member, and tightening such nuts fitting such horizontal bolts is arranged to clamp such first clamp subassembly so as to tightly hold onto the transversely opposed longitudinal bottom lips of the open web joist.

Pipe clamp holder assemblies 84 and 85 consist of two L-shaped brackets 86 and 88. Preferably, L-shaped bracket 88 is formed such that it has a semi-circular bottom cut-out 104. The semi-circular bottom cut-out 104 may be any size required to adequately encircle and clamp the pipe 100 in conjunction with lower semi-circular pipe clamping member 98. These load holding assemblies (98 and 104) embody herein a set of load holding assemblies structured and arranged to attach such first clamp assembly and such second clamp assembly to the load; and further embody herein where each such load holding assembly comprises a pipe-holding clamp structured and arranged to support a load-holding pipe; and still further wherein such set of load holding assemblies are structured and arranged to support a basketball equipment assembly. Extending longitudinally from the long leg 87 and long leg 97 of the L-shaped brackets 86 and 88 and connecting the pipe clamp holder assemblies 84 and 85 are two horizontal parallel bolts 90. The two horizontal parallel bolts 90 connect brackets 86 and 88. Preferably, horizontal parallel bolts 90 are comprised of ½ inch diameter "all-thread", or, at least, threaded at both ends. A nut 94 is threadably attached at each end of bolts 90 and is mounted such that tightening the bolts, in well known ways by those skilled in the art, causes the vertical pipe clamp holder assemblies 84 and 85 to be drawn closer to each other horizontally (clamped together). Preferably, bolts 90 are structured and arranged such that they set interior of vertical clamping bolts 92 (embodying herein at least two first vertical bolts, each such first vertical bolt having a first end and a second threaded end). Preferably, vertical clamping bolts 92 are mounted such that they extend from the top 96 of the L-shaped bracket 86 through a first aperture 82 (embodying herein at least two first apertures, in such L-shaped angle member top surface, each such first aperture holding a such first end of one such vertical bolt) in the L-shaped bracket 86 and through to a second aperture 95 (embodying herein, as shown, an upwardly concave-half-clamp member having at least two third apertures, each such third aperture holding a such second threaded end of one such first vertical bolt) in a lower semi-circular pipe clamping member 98. The arrangement is the same on L-shaped bracket 88. Vertical-clamping bolts 92 are mounted such that they extend from the top 96 of the L-shaped bracket 88 through the bracket 88 and through to a lower semi-circular pipe clamping member 98. As Illustrated in FIG. 4, vertical clamping bolts 92, on L-shaped brackets 86 and 88 and connecting the pipe clamp holder assemblies 84 and 85, are preferably a hex head 93 capped bolt on one end with the opposite end being threaded. The vertical clamping bolts 92 extend through the semi-circular pipe clamping member 98 with a nut 99 threadably attached at each of the threaded ends of the vertical clamping bolts 92. As each of the nuts 99 are tightened, in well known ways, the L-shaped brackets 86 and 88 are brought closer to their respective semi-circular pipe clamping members 98.

Vertical clamp 80 is preferably comprised of two bolts 72, an upper U-shaped clamping member 70, and a lower semi-circular pipe clamping member 74. The vertical clamp 80 is held in place by extending two bolts 72 (embodying herein at least one vertical connection system having an upper end and a lower end and sufficient tensile strength to support the hung load) through space 62 (embodying herein that such vertical connection system is structured and arranged so that an upper portion of said vertical connection system will be situated substantially within the longitudinal open middle portion of the open-web joist) and passing through upper U-shaped clamping member 70 at the top (joist) end and a lower semi-circular clamping member 74 at the bottom (pipe) end. Member 70 embodies herein a structural member comprising a flat portion, and at least one attachment between said structural member and said upper end (of the vertical connection system, wherein said structural member is structured and arranged so that said flat portion will be supported only over the longitudinal open middle portion of the open-web joist. Preferably, bolts 72 are comprised of ½ inch diameter "all-thread" or at a minimum, threaded several inches at both ends of the bolt. A nut 76 is threadably attached at each end of bolts 72 and is mounted such that tightening the bolts, in well known ways by those skilled in the art, causes the U-shaped clamping member 70 and semi-circular clamping member 74 to be drawn closer to each other (clamped together). A lock washer 78 may also be used between the nut 76 and the clamping member to further secure the nut 76 and prevent the nut 76 from coming loose. The vertical clamp 80 provides-additional vertical support for the main mast frame assembly pipe members, 3-½" O.D. tubing members 32*a*, 32*b* and 32*c* (previously described above).

Referring back to FIGS. 1 and 3, and referring also to FIG. 5, the illustrated preferred embodiment of the present invention is illustrated being used to support a typical basketball main mast frame assembly supported from pipe members

32*a*, 32*b* and 32*c*, 3-½" O.D. tubing members such as described above in reference to FIG. 1. Vertical clamp 80 is installed such that the U-shaped clamping member 70 (embodying herein, with the upper ends of the bolts attaching thereto, a hanger, structured and arranged to be supported by the open-web joist only adjacent and above the longitudinal open middle portion, arranged to support a hung load) fits over the middle of the open web steel joist 50 at the top portion 66 of the bottom pair of generally L-shaped steel angles 58 and 60 which are arranged in an upside-down T-shape, back-to-back. The pipe 100 is held and supported by vertical clamp 80 by the two bolts 72 extending from the U-shaped clamping member 70 through space 62 and passing through a semi-circular clamping member 74 (embodying herein, with the bottom ends of the bolts attached thereto, a capture, structured and arranged to be supported by said hanger, arranged to capture the hung load), which encircles the pipe 100. The vertical clamp provides vertical support for the main mast frame assembly pipe 100 in conjunction with the horizontal clamp 89 as further described below. Horizontal clamp 89 consists of two vertical pipe clamp holders 84 and 85. Pipe clamp holder assemblies 84 and 85 attach by friction and clamping means to the open web steel joist 50 at the horizontal portion 105 and 106 of the bottom pair, of the bottom of the "T", of the generally L-shaped steel angles 58 and 60. The top portion 96 of the L-shaped brackets 86 and 88 fits over the top of the horizontal portion 105 and horizontal portion 106 of the L-shaped steel angles 58 and 60. The vertical pipe clamp holder assemblies 84 and 85 encircle pipe 100 with each of the semi-circular pipe clamping members 98 in combination with the L-shaped brackets 86 and 88. Preferably, the horizontal clamp 89 is tightened by tightening the nuts 94 and 99 such that the vertical pipe clamp holder assemblies 84 and 85 are drawn together both vertically and horizontally, causing the pipe 100 to be clamped to the vertical pipe clamp holder assemblies 84 and 85 and the vertical pipe clamp holder assemblies 84 and 85 to be clamped to the L-shaped steel angles 58 and 60 of the open web steel joist 50.

FIG. 8 is a side view, partially in-section, through the section 8—8 of FIG. 5. FIG. 8 illustrates vertical pipe clamp holder 85 in a clamped position onto pipe 100. Vertical pipe clamp holder assembly 84 is a mirror image of vertical pipe clamp holder assembly 85. Pipe clamp holder assembly 85 consist of an L-shaped bracket 88. Preferably, L-shaped bracket 88 is formed such that it has a semi-circular bottom cut-out 104. The semi-circular bottom cut-out 104 may be any size required to adequately encircle and clamp the pipe 100 in conjunction with lower semi-circular pipe clamping member 98. The assembly of semi-circular bottom cut-out 104 and lower semi-circular pipe clamping member 98 embody herein a third clamp means for attaching such first clamp means and such second clamp means to the load; and such third clamp means comprises a pipe-holding means for supporting a load-holding pipe and further such third clamping means structured and arranged to support a basketball equipment assembly; wherein such third clamping means comprises a pipe-holding means for supporting a basketball equipment assembly. Extending longitudinally from the long leg 89 of the L-shaped brackets 88 and connecting the pipe clamp holder assembly 85 and 86 are two horizontal parallel bolts 90 (embodying-herein a first clamp assembly comprising at least two horizontal bolts, each such horizontal bolt having a first threaded end and a second threaded end) extending through apertures 83 (embodying herein at least two second apertures, in such side surface, each such second aperture holding one end of one such horizontal bolt). Preferably, bolts 90 are arranged such that they set interior of vertical clamping bolts 92 (embodying herein at least two vertical bars, each having a first end and a second end; and at least two first vertical bolts, each such first vertical bolt having a first end and a second threaded end). Preferably, vertical clamping bolts 92 are mounted such that they extend from the top 96 of the L-shaped bracket 88 through the bracket 88 and through to a lower semi-circular pipe clamping member 98. The arrangement is the same on L-shaped bracket 86. As Illustrated in FIG. 8, vertical clamping bolts 92 on L-shaped bracket 88, which connect to the pipe clamp holder assembly 85, are preferably a hex head 93 capped bolt on one end with the opposite end being threaded. The vertical clamping bolts 92 extend through the semi-circular pipe clamping member 98 with a nut 99 threadably attached at each of the threaded ends of the vertical clamping bolts 92 (this arrangement embodying herein at least two first vertical bolts, each such first vertical bolt having a first end and a second threaded end; and at least two first threaded nuts, each such first threaded nut fitting one such second threaded end of one such first vertical bolt). As each of the nuts 99 are tightened, in well known ways, the L-shaped bracket 88 is brought closer to the semi-circular pipe clamping member 98 therein clamping pipe 100 tightly (embodying herein-tightening such nuts fitting such first vertical bolts clamps together each such L-shaped angle member with each such upwardly concave half-clamp member). Preferably, vertical clamp 80 is arranged such that it is centered within pipe clamp holder assemblies 85 and 86. This arrangement embodies herein that such second clamp assembly is substantially centered with respect to such first clamp assembly; and that such second clamp means is substantially centered with respect to such first clamp means. The combination of the multiple clamping members provides such a system that supports a load with both a vertical clamp 80 that provides direct vertically support from the open web joist and indirect vertical support utilizing a horizontal clamp 89. The combination of the vertical clamp 80 and horizontal clamp 89 installed together improves the holding power of the triple clamp 40 over the prior art clamp. The preferable centering of the vertical clamp 80 within the horizontal clamp 89 increases even further the holding ability and reduces even further slippage of the basketball equipment assembly 20 structure over the prior art. Even in theory, applicant's provision of "direct" vertical support by a "vertical" clamp to the load (in conjunction with the "horizontal" clamp's "indirect" vertical support) effectively reduces the tendency of the horizontal clamp to travel along or fall off the joist. And applicant's testing and use have shown this improvement to be actual as well as theoretical. It is noted that applicant's vertical clamp subassembly alone (even without using the horizontal clamp subassembly) is effective in many applications to support a load from the center open portion of an open web joist.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. An open-web-joist clamping system for supporting a load from an open-web joist, having a longitudinal open middle portion and transversely opposed longitudinal bottom lips, comprising, in combination:

a) a first clamp means for supporting the load while clamping the joist horizontally; and b) a second clamp means for supporting the load while clamping the joist vertically;

c) wherein said second clamp means is adjacent said first clamp means.

2. The clamping system of claim 1 wherein said second clamp means s structured and arranged to clamp on the open-web joist adjacent the open middle-portion.

3. The clamping system of claim 2 wherein said first clamp means is structured and arranged to clamp onto the transversely opposed longitudinal-bottom lips.

4. The clamping system of claim 3 further comprising a third clamp means for attaching said first clamp means and said second clamp means to the load.

5. The clamping system of claim 4 wherein said third clamp means comprises a pipe-holding means for supporting a load-holding pipe.

6. The clamping system of claim 4 wherein said third clamp means is structured and arranged to support a basketball equipment assembly.

7. The clamping system of claim 6 wherein said third clamp means comprises a pipe-holding means for supporting a basketball equipment assembly.

8. The clamping system of claim 1 wherein said second clamp means is substantially centered with respect to said first clamp means.

9. An open-web-joist clamping system for supporting a load from an open-web joist, having a longitudinal open middle portion and transversely opposed longitudinal bottom lips, comprising, in combination:

a) at least one first clamp assembly structured and arranged to support the load while clamping the joist horizontally; and b) at least one second clamp assembly structured and arranged to support the load while clamping the joist vertically;

c) wherein said second clamp assembly is adjacent said first clamp assembly.

10. The clamping system of claim 9 wherein said second clamp assembly is structured and arranged to clamp the open-web joist vertically adjacent the open middle portion.

11. The clamping system of claim 10 wherein said first clamp assembly is structured and arranged to clamp said first clamp assembly so as to tightly-hold onto the-transversely opposed longitudinal bottom lips of the open web joist.

12. The clamping system of claim 11 further comprising a set of load holding assemblies structured and arranged to attach said first clamp assembly and said second clamp assembly to the load.

13. The clamping system of claim 12 wherein each said load holding assembly comprises at least one pipe-holding clamp structured and arranged to support a load-holding pipe.

14. The clamping system of claim 12 wherein said set of load holding assemblies are structured and arranged to support a basketball equipment assembly.

15. The clamping system of claim 14 wherein said set of load holding assemblies comprises a set of pipe-holding clamps structured and arranged to support a basketball equipment assembly.

16. The clamping system of claim 12 wherein said first clamp assembly and said second clamp assembly each provide independent support to the load.

17. The clamping system of claim 9 wherein said second clamp assembly is substantially centered with respect to said first clamp assembly and wherein said second clamp assembly comprises:

a) at least two vertical bars, each having a first end and a second end;

b) a structural member comprising a flat portion, comprising at least two first apertures, each holding one said first end of one said vertical bar;

c) a load-support member having at least two second apertures, each holding one said second end of one said vertical bar; and d) at least two bar-height adjusting members, each fitting one said end of one said vertical bar;

e) wherein said structural member is structured and arranged so that said flat portion may be supported only over the longitudinal open middle portion of the open-web joist; and f) wherein said load-support member is structured and, arranged to support the load;

g) whereby adjusting said bar-height adjusting members causes said structural member and said load-support member to be drawn closer together, thereby supporting the load by the open-web joist.

18. The clamping system of claim 9 wherein:

a) said at least one first clamp assembly comprises at least one L-shaped angle member having a planar top surface and a side surface;

b) said at least one L-shaped angle member further comprises at least two apertures in said planar top surface; and c) each said aperture is structured and arranged to hold at least one end of at least one vertical bolt.

19. An open-web-joist clamping system for supporting a load from an open-web joist, having a longitudinal open middle portion and a pair of transversely opposed longitudinal bottom lips, comprising, in combination:

a) a first clamp assembly comprising i) at least two horizontal bolts, each said horizontal bolt having a first threaded end and a second threaded end, ii) two opposing clamp subassemblies wherein each said opposing clamp subassembly comprises (1) at least two first vertical bolts, each said first vertical bolt having a first end and a second threaded end, (2) an inverted L-shaped angle member having a planar top surface and a side surface, (3) at least two first apertures, in said L-shaped angle member top surface, each said first aperture holding a said first end of one said vertical bolt, (4) at least two second apertures, in said side surface, each said second aperture holding one end of one said horizontal bolt, (5) an upwardly concave half-clamp member having at least two third apertures, each said third aperture holding a said second threaded end of one said first vertical bolt, (6) at least two first threaded nuts, each said first threaded nut fitting one said second threaded end of one said first vertical bolt, (7) at least two second threaded nuts, each said second threaded nut fitting said one end of said horizontal bolt, (8) wherein a bottom portion of said side surface comprises a downwardly concave clamping surface, (9) wherein a leading portion of said top surface of said inverted L-shaped angle member is structured and arranged to fit over one transversely opposed longitudinal bottom lip of the open web joist,

(10) wherein said upwardly concave half-clamp member is structured and arranged to support the load, and

(11) wherein said first vertical bolts connect said L-shaped angle member and said upwardly concave half-clamp member, iii) whereby (1) tightening said first threaded nuts fitting said first vertical bolts clamps together each said L-shaped angle member with each said upwardly concave half-clamp member, and (2) tightening said second threaded nuts fitting said horizontal bolts clamps each said opposing clamp subassembly so as to tightly hold onto the transversely opposed longitudinal bottom lips of the open web joist; and b) a second clamp assembly comprising i) at least two second vertical bolts, each having a first threaded end and a second threaded end, ii) an inverted U-shaped channel member having (1) a flat top portion, comprising at least two fourth apertures, each holding one said first threaded end of said second vertical bolt, and (2) two side portions, iii) an arcuate half-clamp member having at least two fifth apertures, each holding one said second threaded end of said second vertical bolt, and iv) a least four third threaded nuts, each fitting one said threaded end of one said second vertical bolt, v) wherein said inverted U-shaped channel member is structured and arranged so that said flat top portion may be supported only over the longitudinal open middle portion of the open-web joist, and vi) wherein said arcuate half-clamp member is structured and arranged to support the load, vii) whereby tightening said third threaded nuts causes said inverted U-shaped channel member and said arcuate half-clamp member to be drawn closer together thereby supporting the load by the open-web joist;

c) wherein said second clamp assembly is substantially centered with respect to said first clamp assembly; whereby, when said first clamp assembly and said second clamp assembly are both supported by the open-web joist and are both supporting the load, said first clamp assembly and said second clamp assembly function together to provide improved load support.

* * * * *

UNITED STATES PATENT AND TRADEMARK OFFICE

CERTIFICATE OF CORRECTION

PATENT NO. : 6,609,343 B1
DATED : August 26, 2003
INVENTOR(S) : Litten, Timothy A.

It is certified that error appears in the above-identified patent and that said Letters Patent is hereby corrected as shown below:

Column 11,
Line 8, “means s structured” should read -- means is structured --
Line 12, “longitudinal-bottom” should read -- longitudinal bottom --
Line 44, “tightly-hold onto the-transversely” should read -- tightly hold onto the transversely --

Column 12,
Line 16, after “structured and,” should read -- structured and --

Signed and Sealed this

Eighteenth Day of November, 2003

JAMES E. ROGAN
*Director of the United States Patent and Trademark Office*